United States Patent [19]

Sanders et al.

[11] 4,444,545

[45] Apr. 24, 1984

[54] PUMP CONTROL SYSTEM

[76] Inventors: David F. Sanders; James R. Aspinwall; Garry A. Armbruster, all of 5485 NW. 22nd Ave., Fort Lauderdale, Fla. 33309

[21] Appl. No.: 366,500

[22] Filed: Apr. 8, 1982

[51] Int. Cl.[3] ..... F04B 41/06

[52] U.S. Cl. ..... 417/8; 307/118; 417/36; 417/38; 417/40; 417/63

[58] Field of Search ..... 417/7, 8, 63, 36–40, 417/13, 12, 44; 307/118

[56] References Cited

U.S. PATENT DOCUMENTS

| | | | |
|---|---|---|---|
| 2,157,329 | 5/1939 | Fillo | 417/7 |
| 3,050,003 | 8/1962 | Edwards | 103/25 |
| 3,136,871 | 6/1964 | Barletta | 417/36 |
| 3,667,022 | 5/1972 | Quinn | 318/462 |
| 3,914,752 | 10/1975 | Howard et al. | 340/242 |
| 4,179,242 | 12/1979 | Tateshita et al. | 417/8 |
| 4,297,081 | 10/1981 | Irvin | 417/2 |

*Primary Examiner*—Edward K. Look

*Attorney, Agent, or Firm*—Oltman and Flynn

[57] ABSTRACT

This is a digital solid state control system for pumping liquid to regulate the condition of the liquid in a container, such as the liquid level. One pump is turned on when the liquid rises to one level, and another pump is turned on when the liquid rises to a higher level. An alarm is activated if the liquid rises to a still higher level or if a leak occurs in either pump. The control system alternates which pump turns on first in successive operating cycles. If a power failure occurs while both pumps are on, when power is restored only one pump comes on immediately; the other comes on only after a time delay.

19 Claims, 4 Drawing Figures

OUTPUTS
PUMP A
INDICATOR
101a
PUMP B
INDICATOR
101b
ALARM
25
20a
SELECTOR SWITCH
20b
SELECTOR SWITCH
18a
18b
70
17
FIRST PUMP SELECTOR
19
DELAY ON POWER UP
24
INTERMITTENT
16
START LATCH
22
OVERRIDE LATCH
23
SELECTOR
15
CIRCUIT ENABLE
31
ALARM ON SEAL LEAK
29
INDICATOR
30
INDICATOR
11'
12'
13'
14'
27
28
INPUTS
STOP
START 1ST
START 2ND
ALARM
SEAL LEAK A
SEAL LEAK B

B
A
10
14
13
12
11
ALARM
START 2ND
START 1ST
STOP

PUMP CONTROL SYSTEM

SUMMARY OF THE INVENTION

This invention relates to a pump control system to regulate the condition of liquid (e.g., liquid level) in a tank or other container.

In accordance with this invention, a novel solid state control system is provided which controls the operation of two pumps, one of which is turned on when the liquid condition in the container reaches a first state (e.g., a certain liquid level) and the other of which is turned on to run simultaneously with the first pump when the liquid condition in the container reaches a second state (e.g., a higher liquid level). Both pumps are turned off when the pumps have caused the liquid in the container to change to a condition (e.g., a low liquid level) in which pump operation is no longer required. The present control system signals an alarm when the liquid condition in the container is such as to require the operator's attention. Also, preferably, the present control system signals an alarm in the event of a leak in either pump.

In accordance with one aspect of the present invention, a power failure while both pumps are on cannot result in both pumps coming on simultaneously when power is restored. In that case, only one pump comes on right away, and the other comes on only after a time delay so that an overload or other possible malfunctions cannot occur.

A principal object of this invention is to provide a novel and improved pump control system to regulate the condition of liquid in a container.

Another object of this invention is to provide such a control system having novel solid state circuitry for controlling the operation of two pumps.

Another object of this invention is to provide a novel control system for two pumps which turn on the pumps sequentially and, in the event of a power failure when both pumps are on, prevents both pumps from coming on simultaneously when the power is restored.

Another object of this invention is to provide a novel pump control system having novel circuitry for turning on alarms under various abnormal conditions of operation.

Further objects and advantages of this invention will be apparent from the following detailed description of a presently-preferred embodiment, which is illustrated schematically in the accompanying drawings.

Before explaining the disclosed embodiment of the present invention in detail, it is to be understood that the invention is not limited in its application to the details of the particular arrangement shown, since the invention is capable of other embodiments. Also, the terminology used herein is for the purpose of description and not of limitation.

DETAILED DESCRIPTION

Figures 1, 2:
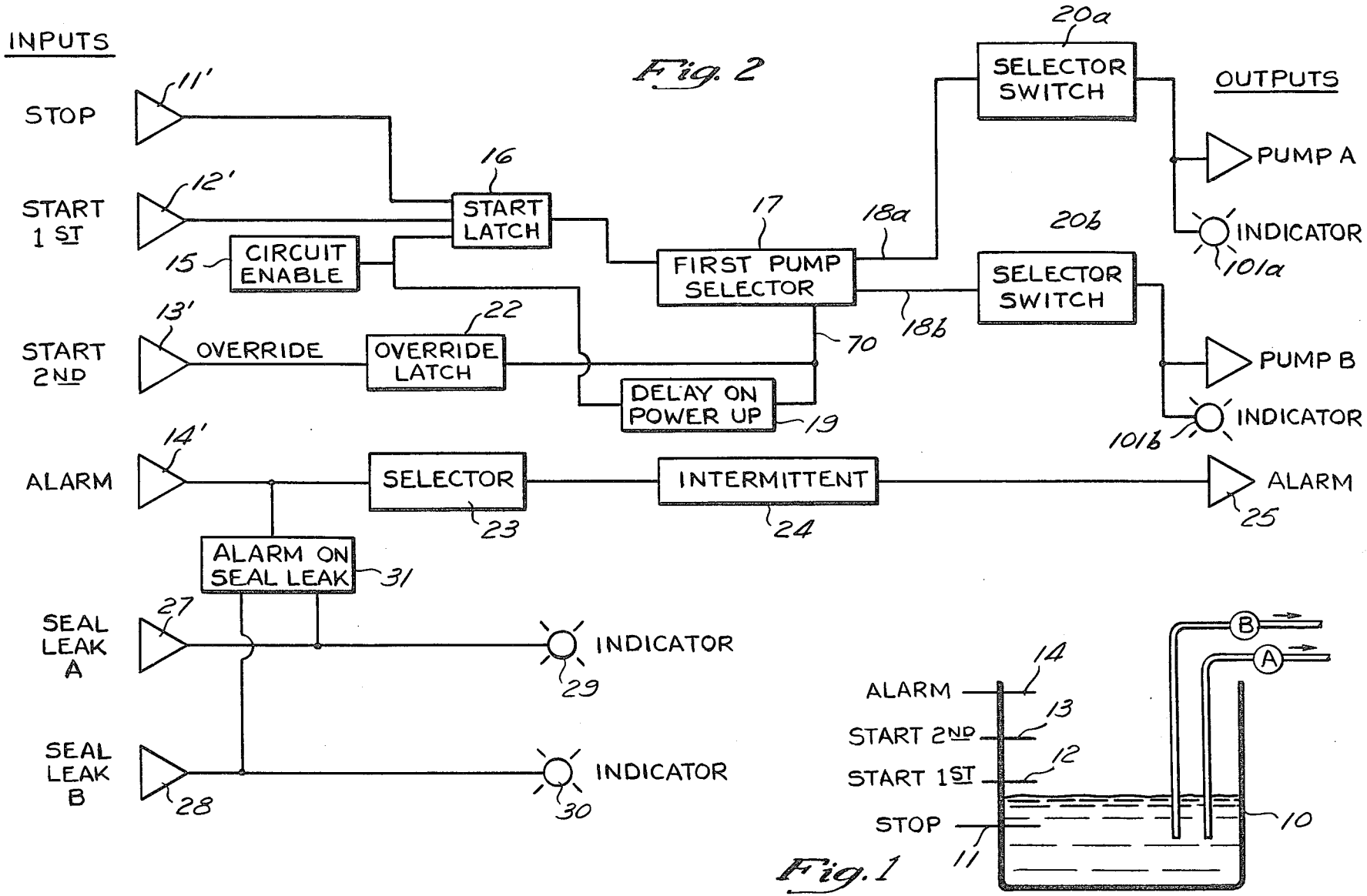
FIG. 1 illustrates a liquid reservoir whose liquid level is regulated by two pumps operated by the control system of the present invention.
FIG. 2 is a schematic electrical block diagram of the present control system.

The present control system is for the purpose of regulating the liquid level in a tank or other reservoir, as shown schematically at 10 in FIG. 1. Two pumps A and B are operatively arranged to pump liquid out of the tank under the control of sensors, such as float switches or control contacts or pressure switches, for example.

The lowermost float switch, shown at line 11, is a normally-open switch which is open when the liquid level is below line 11 and closes when the liquid level is at or above line 11. Switch 11 is binary since it has just two possible states, open and closed. Its binary state depends upon the liquid level which it senses. In the claims, switch 11 is referred to as a "first binary sensor". The function of switch 11, which will be referred to in this description as the "stop" switch, is to keep both pumps A and B off as long as the liquid level is below line 11 and to enable the pumps to be on when the liquid level is at or above line 11, as explained in detail hereinafter.

The next higher switch, at line 12, is a normally-open switch which is open as long as the liquid level is below line 12 and is closed when the liquid level is at or above line 12. In the claims, switch 12 is referred to as a "second binary sensor". The function of switch 12, which will be referred to in this description as the "start first pump" switch, is to turn on the first pump A or B in response to the liquid level's rising to or past line 12.

A still higher switch, shown at line 13, is a normally-open switch which is open as long as the liquid level is below line 13 and is closed when the liquid level is at or above this line. In the claims, switch 13 is referred to as a "third binary sensor". The function of switch 13, which will be referred to in this description as the "start second pump" switch, is to turn on the other pump (the one which was not turned on by switch 12) in response to the liquid level's rising to or above line 13.

The highest switch, at line 14, is a normally-open switch which closes when the liquid level rises above this line and triggers an audible or visual alarm, or both, to signal that the liquid level in the tank 10 is excessively high. In the claims, switch 14 is referred to as a "fourth binary sensor".

Referring to the block diagram of FIG. 2, the stop switch 11 is in a circuit block 11' which is connected to a "start latch" circuit block 16 controlled by a "circuit enable" block 15 containing a power on/off switch. As explained in detail hereinafter, as long as stop switch 11 is open (i.e., as long as the liquid level is below line 11 in FIG. 1) both pumps A and B are off. When stop switch 11 closes (i.e., when the liquid level is at or above line 11), it produces an output signal which enables one pump, or both in sequence, to be turned on when other events occur, as explained hereinafter. Each time switch 11 closes, it changes the sequence in which the two pumps can come on.

The start first pump switch 12 is in a circuit block 12' which is connected to the start latch circuit block 16. When both switches 11 and 12 are closed (i.e., when the liquid level is at or above line 12 in FIG. 1), the start latch circuit block 16 produces an output signal for turning on the first pump (which may be either pump A or pump B) to begin pumping liquid out of tank 10. This pump turn-on signal from the start latch circuit block 16 is applied to a pump selector circuit block 17 having two outputs **18*a* and 18*b*, which are connected through respective selector switches 20*a* and 20*b* to circuits for turning on pumps A and B, respectively. The selector circuit 17 determines which of the two pumps is turned on by the closing of the start first switch 12. Each time the stop switch 11 closes, it produces a signal which causes the start latch block 16 to change the selector 17 to its alternate state so that, for example, if pump A was turned on by the last preceding closing of switch 12, the other pump B will be turned on (and pump A will not) the next time switch 12** closes.

The start second switch 13 is in a circuit block 13' which is connected to the input of an override latch circuit block 22 having its output connected to the first pump selector 17. When switch 13 closes (in response to the liquid level's rising to or above line 13 in FIG. 1) it causes the override latch circuit block 22 to produce an output signal which causes selector 17 to turn on whichever of the two pumps A and B was not turned on by the previous closing of switch 12.

A time delay circuit 19 prevents both pumps from being turned on simultaneously or substantially simultaneously.

Assume, for purposes of discussion, that the liquid level in tank 10 is below line 11 initially. Under these circumstances, both pumps A and B will be off.

When the liquid level rises to line 11, stop switch 11 will close and (assuming that the power on/off switch in "circuit enable" block 5 is closed) it will produce a signal which is applied to the start latch circuit block 16 and selector 17 for enabling them to turn on the pumps. However, neither pump A nor pump B is turned on until the liquid level has risen to line 12.

When the liquid level rises to line 12 and the start switch 12 closes, it turns on pump A or B, depending upon the condition of selector 17, and this pump begins to withdraw liquid from tank 10. If this pump withdraws liquid from the tank faster than it is coming in, the liquid level in the tank will drop until it falls below line 11 in FIG. 1 at which time switch 11 will reopen, causing the pump to be turned off. However, if after the first pump comes on, the liquid level continues to rise in the tank until it reaches line 13 in FIG. 1, the start second switch 13 will close and cause the override latch block 22 to produce a signal which turns on the second pump. With both pumps now operating, the liquid level in tank 10 should drop. Both pumps will remain on until the liquid level drops below line 11 in FIG. 1, at which time the stop switch 11 will reopen, causing both pumps to be turned off.

If, with both pumps on, the liquid level in the tank continues rising, when it reaches line 14 in FIG. 1 the alarm switch 14 will close and turn on audible and visual alarm signalling devices 25 and 31 to signal that an emergency condition now exists. This alarm signal from switch 14 is applied through a selector circuit block 23 to an intermittent circuit 24 which operates the audible alarm device 25.

The control also includes a circuit 27 which responds to a leak through the seal of pump A and a similar circuit 28 for pump B. These leak circuits are arranged to turn on corresponding indicator lamps 29 and 30 when a leak is detected. Also, both leak circuits 27 and 28 are connected through a circuit block 31 to the input of selector circuit block 23 so that if either pump develops a leak the audible alarm device 25 will be turned on.

Either pump can be turned on or off by a manual switch which bypasses the present automatic control circuit.

FIG. 3A

The stop circuit block 11', the "start first pump" circuit block 12' and the "start second pump" circuit block 13' have identical circuits except for the float switches which operate them.

Figure 3A:
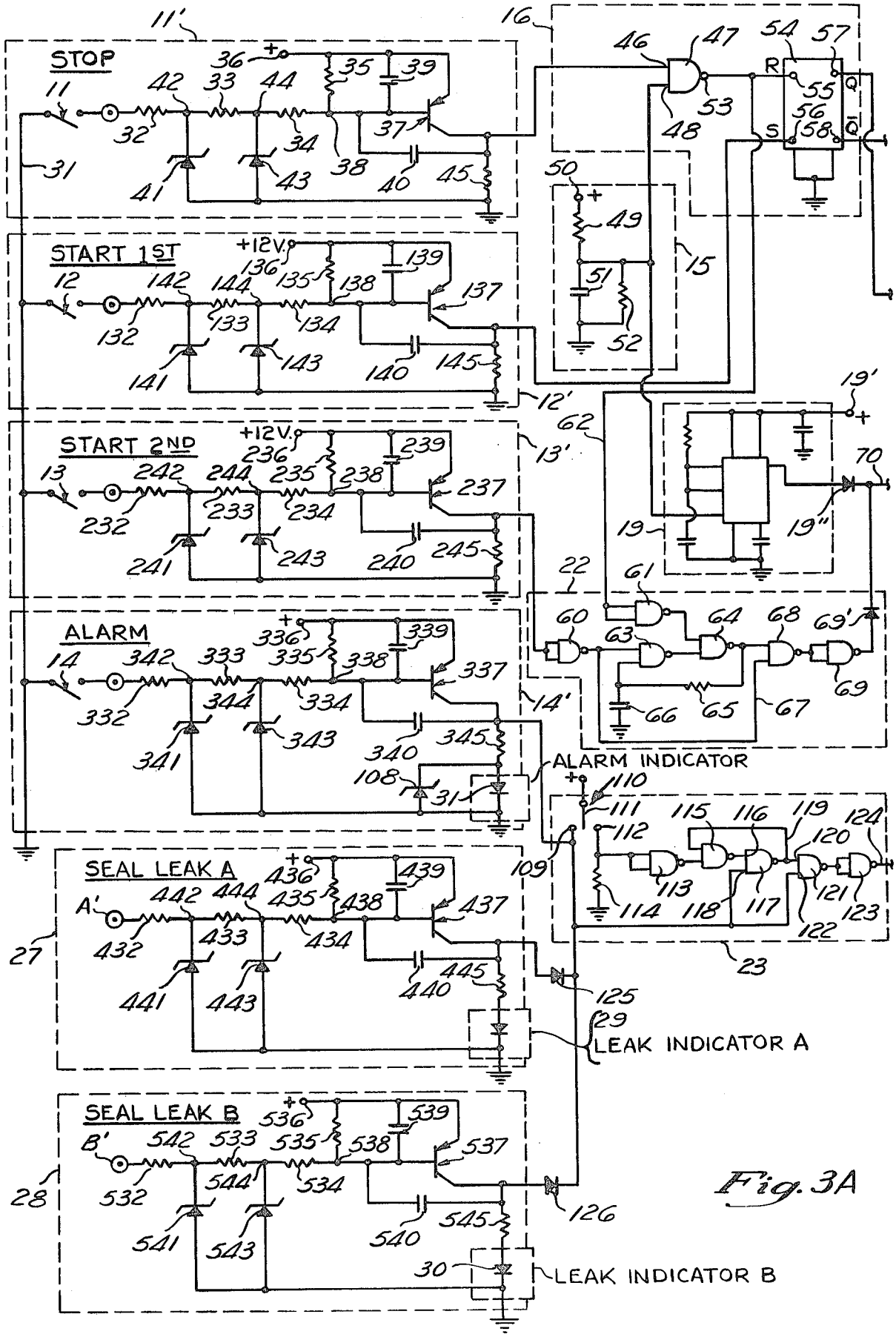
FIG. 3 is a more detailed circuit diagram of this control system.

Referring to FIG. 3A, the stop circuit block 11' has a grounded line 31 connected to the mobile contact **11*a* of float switch 11. The fixed contact of this float switch is connected through resistors 32, 33, 34 and 35 in series to a +12 volt power supply terminal 36. A PNP transistor 37 has its emitter connected directly to power supply terminal 36 and its base connected to the junction point 38 between resistors 34 and 35. A capacitor 39 is connected in parallel with resistor 35 between the power supply terminal 36 and the base of transistor 37. A capacitor 40 is connected between the base and the collector of transistor 37. A first Zener diode 41 is connected between the junction point 42 of resistors 32 and 33 and ground. A second Zener diode 43 is connected between the junction point 44 of resistors 33 and 34 and ground. A resistor 45 is connected between the collector of transistor 37** and ground.

As long as the stop switch 11 is open, transistor 37 will be off. When switch 11 closes, it turns on transistor 37.

The circuit elements of the start first pump circuit block 12' have the same reference numerals plus 100 as corresponding circuit elements in the stop circuit block 11', which have just been described. When the start first pump switch 12 closes, transistor 137 is turned on.

Similarly, the circuit elements of the start second pump circuit block 13' have the same reference numerals plus 200 as corresponding elements in the stop circuit block 11'. When the start second pump switch 12 closes, transistor 237 is turned on.

Referring again to the stop circuit block 11', the collector of transistor 37 is connected directly to one input terminal 46 of a NAND gate 47 in the start latch circuit block 16. NAND gate 47 has a second input terminal 48 connected to the lower end of a resistor 49 whose upper end is connected to a +12 volt power supply terminal 50. A parallel combination of capacitor 51 and resistor 52 is connected between NAND input terminal 48 and ground. When power supply terminal 50 is energized, input terminal 48 of NAND gate 47 is high. As long as stop switch 11 is open, the other input terminal 46 of NAND gate 47 is low and its output terminal 53 is high.

When the stop switch 11 closes, turning on transistor 37, both inputs to NAND gate 47 are high and its output terminal 53 goes low.

The start latch circuit block 16 includes a "set-reset" flip-flop 54 having its reset input terminal 55 connected directly to the output terminal 53 of NAND gate 47. Flip-flop 54 has its set input terminal 56 connected directly to the collector of transistor 137 in the start first pump circuit block 12'. As long as the start first pump float switch 12 is open, the set terminal 56 of flip-flop 54 will be low.

The start latch flip-flop 54 operates as follows:

(a) When the liquid level is below line 11 in FIG. 1, switches 11 and 12 will be open, flip-flop reset input terminal 55 will be high and its set input terminal 56 will be low, the Q output terminal 57 of flip-flop 54 will be low, and its Q output terminal 58 will be high.

(b) When the liquid rises above line 11 but not as far as line 12, switch 12 will be open and therefore flip-flop reset terminal 55 will now be low, but flip-flop terminals 56, 57 and 58 remain low, low and high, respectively.

(c) When the liquid level reaches line 12, switch 12 closes, causing the set terminal 56 of flip-flop 54 to go high. With the reset terminal 55 low, the Q output terminal 57 now goes high and the Q output terminal 58 goes low.

OVERRIDE LATCH 22

The override latch circuit block 22 in FIG. 3A includes a NAND gate 60 having both of its input terminals connected to the collector of transistor 237 in the "start second pump" block 13', so that this NAND gate acts as an inverter. A second NAND gate 61 in block 22 has both of its input terminals connected by line 62 to the reset terminal 55 of flip-flop 54, and this NAND gate also acts as an inverter.

The output of NAND gate 60 is connected to one input terminal of a NAND gate 63, whose output terminal is connected to one input terminal of a NAND gate 64. The other input terminal of NAND gate 64 is connected to the output terminal of NAND gate 61. The output terminal of NAND gate 64 is connected through a feedback resistor 65 to the second input terminal of NAND gate 63. A capacitor 66 is connected between this input terminal and ground. The output terminal of NAND gate 60 also is connected via line 67 to one input terminal of a NAND gate 68, which has its other input terminal connected to the output terminal of NAND gate 64. The outout terminal of NAND gate 68 is connected to both input terminals of NAND gate 69, which acts as an inverter. The output terminal of NAND gate 69 is connected through a rectifier 69' to line 70 which in FIG. 3B extends into the pump selector circuit block 17.

As long as the liquid level is below line 11, the signal at the reset terminal 55 of flip-flop 54 will be high, as already described. Also, with the "start second pump" switch 13 open, transistor 237 in the "start second pump" circuit block 13 will be off. Consequently, the input signal to NAND gate 60 will be low and its output will be high. The input signals to NAND gate 61 will be high and its output will be low. The output of NAND gate 63 will be low, the output of NAND gate 64 will be high, the output of NAND gate 68 will be low, and the output of NAND gate 69 will be high, causing a high signal to appear on line 70.

When the liquid level rises above line 11, closing the stop switch 11 in circuit block 11', this turns on transistor 37 and causes the signal on line 62 to go low, so that the output of NAND gate 61 goes high. No other change takes place in circuit block 22 and the signal on line 70 remains high.

If the liquid level rises far enough to close the "start second pump" switch 13, transistor 237 in circuit block 13 will be turned on, causing the inputs to NAND gate 60 to go high and its output to go low. This causes the output of NAND gate 63 to go high. The output of NAND gate 64 now goes low, the output of NAND gate 68 goes high, and the output of NAND gate 69 goes low, removing the high signal on line 70.

The low signal on line 70 persists after switch 13 reopens when the liquid level drops below line 13 in FIG. 2. When switch 13 opens again, transistor 237 goes off, causing the output signal from NAND gate 60 to go high. This is the only change that takes place in circuit block 22. The output signal from NAND gate 63 remains high. The output signal from NAND gate 61 remains high as long as stop switch 11 remains closed. The output signal from NAND gate 64 remains low, the output signal from NAND gate 68 remains high, and the output signal from NAND gate 69 remains low.

A high signal will appear again on line 70 when the liquid level next drops below line 11, opening the stop switch 11.

This turns off transistor 37 in circuit block 11' and causes the reset terminal 55 of flip-flop 54 in circuit block 16 to go high. This causes the output of NAND gate 61 in circuit block 22 to go low. The output of NAND gate 64 goes high, the output of NAND gate 68 goes low, and the output of NAND gate 69 goes high. This puts a high signal on line 70 which turns off the second pump, which had gone on in response to the immediately preceding closing of switch 13.

If, with switches 12 and 13 having been closed in sequence, so that both pumps are running, there is a malfunction in switch 12 which causes it to reopen while the liquid level is still above line 13 in FIG. 1, this will produce no change in circuit block 22 and it will produce no change in the output signals from flip-flop 54. Therefore, both pumps would stay on until switch 11 reopens.

PUMP SELECTOR 17

The pump selector circuit block 17 includes a first NAND gate **71*a* which, when its output signal goes low, turns on pump A. This block has a second NAND gate 71*b*** which, when its output goes low, turns on pump B.

Figure 3B:
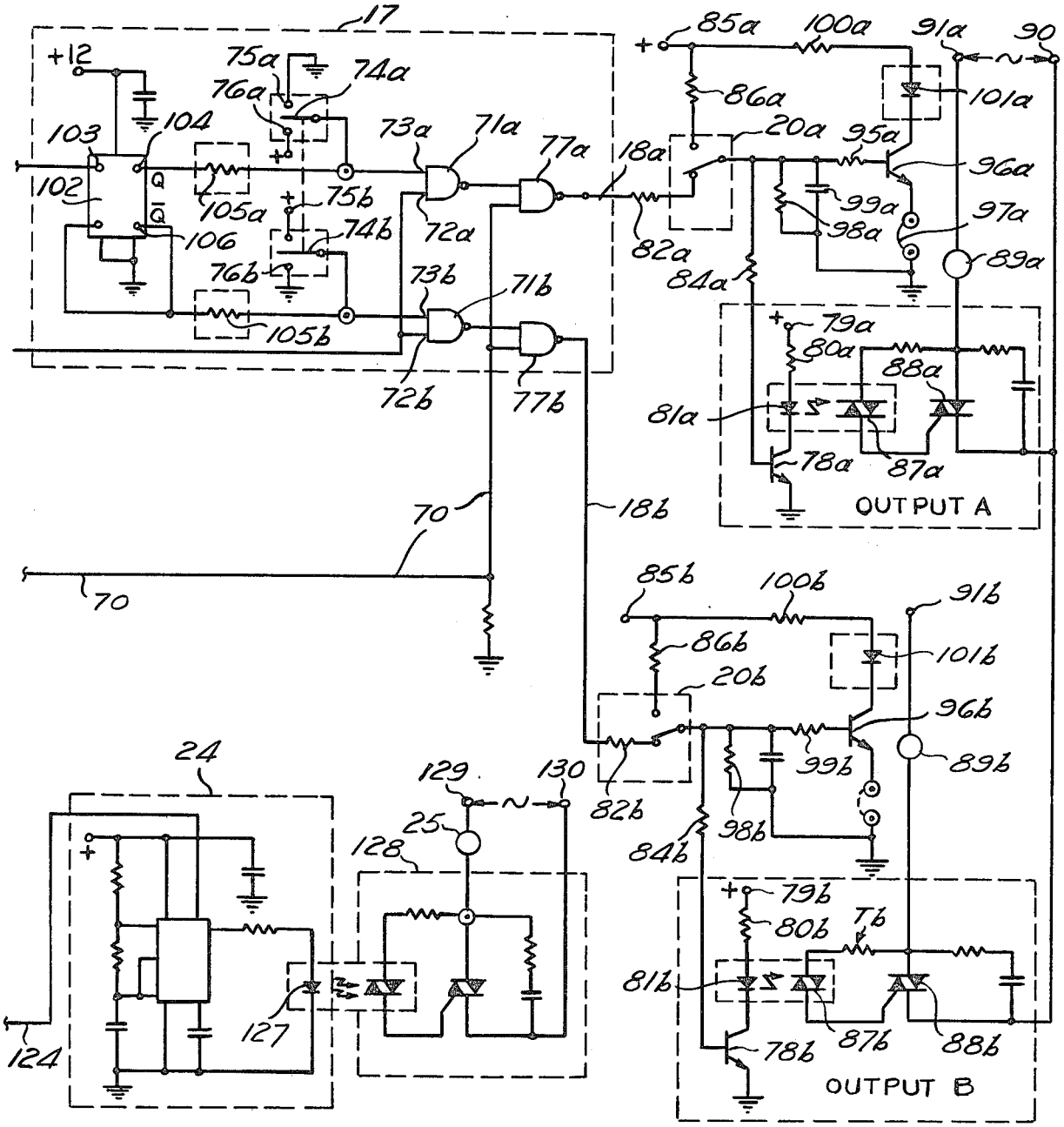

The lower input terminal **72*a* of NAND gate 71*a* is connected to the output terminal 57 of the start latch flip-flop 54, so input terminal 72*a* is low as long as the "start first pump" switch 12 is open. The upper input terminal 73*a* of NAND gate 71*a* is connected to a first mobile contact 74*a* of a three position, manually operated, selector switch. In its normal position, as shown in FIG. 3B, this mobile contact 74*a* is open-circuited. Associated with the mobile contact is an upper fixed contact 75*a*, which is grounded, and a lower fixed contact 76*a***, which is connected to a +12 volt power supply terminal.

When the mobile contact **74*a*** engages the upper fixed contact, pump A cannot come on.

When mobile contact **74*a* engages the lower fixed contact 76*a*, pump A will be on as long as the liquid level is above line 12 in FIG. 1. The selector switch contacts 74*a* and 76*a* supply a high signal to input terminal 73*a* of NAND gate 71*a*. The other input terminal 72*a* of NAND gate 71*a* will go high when the "start first pump" switch 12 closes, as described. Therefore, the output terminal of NAND gate 71*a* will go low. This output terminal of NAND gate 71*a* is connected to one input terminal of a NAND gate 77*a* whose other input terminal is connected to line 70. At this time, with the "start second pump" switch 13 open, the signal on line 70 is high. The output signal from NAND gate 77*a* goes high, turning on a transistor 78*a*** for turning on pump A, as described in more detail hereinafter.

For turning on pump A, +12 volt power supply terminal **79*a* is connected through a resistor 80*a* and a light transmitting diode 81*a* to the collector of transistor 78*a*. The emitter of transistor 78*a* is grounded. The output terminal of NAND gate 77*a* in circuit block 17 is connected to the base of transistor 78*a* through resistor 82*a*, the lower contacts of a selector switch 20*a*, and a resistor 84a. Selector switch 20a is manually operable to the position shown, in which the operation of transistor 78a is under the control of NAND gate 77a, or to a position in which its mobile contact engages the upper fixed contact and connects the base of transistor 78a to a +12 volt power supply terminal 85a through a resistor 86a. In this latter position of selector switch 20a, pump A will be on irrespective of the condition of any of the level-sensing switches 11, 12 and 13 in tank 10**.

When energized, diode 81a turns on a "Triac" 87a which, in turn, turns on a "Triac" 88a connected in series with the starting coil 89a of the motor for pump A across the terminals 90 and 91a of a 120 volt AC power supply.

The mobile contact of selector switch 20a also is connected through a resistor 95a to the base of a transistor 96a whose emitter is connected to ground through a jumper wire 97a. Resistor 98a and capacitor 99a are connected in parallel with each other between the base of transistor 96a and ground to keep the transistor non-conducting in the absence of a positive potential on the mobile contact of selector switch 20a. The +12 volt AC power supply terminal 85a is connected to the collector of transistor 96a through a resistor 100a and a light-emitting diode 101a, which provides a visible signal when transistor 96a is on.

Pump B is under the control of a similar circuit, the elements of which have the same reference numerals but with a "b" suffix instead of an "a" suffix, as those in the control circuit for pump A. The detailed description of the circuit elements associated with pump B will be omitted as unnecessary.

In the position of selector switch 20b shown in FIG. 3B, transistor 78b and 96b are turned on when a high (positive) signal appears at the output of a NAND gate 77b in circuit block 17, which is the counterpart of NAND gate 77a. The lower input terminal of NAND gate 77b is connected to line 70. Its upper input terminal is connected to the output of a NAND gate 71b, which is the counterpart of NAND gate 77a.

The lower input terminal 72b of NAND gate 71b is connected to the Q output terminal 57 of flip-flop 54. The upper input terminal 73b of NAND gate 71b is connected to a second mobile contact 74b of the selector switch which has the previously-described contacts 74a, 75a and 76a. Mobile contact 74a is selectively engaged with an upper fixed contact 75b, which is connected to a +12 volt power supply terminal, or with a lower fixed contact 76b, which is grounded. The mobile contact 74b has a middle position in which it engages neither fixed contact 75a nor 75b and is open-circuited.

The mobile switch contacts 74a and 74b are suitably coupled to each other so that they occupy the same positions relative to the corresponding fixed contacts. For example, when mobile contact 74a engages its upper contact 75a, the other mobile contact 74b engages its upper contact 75b.

It will be evident that when the signal at input terminal 73a of NAND gate 71a is high (positive), the signal at input terminal 73b of NAND gate 71b will be low (ground), and vice versa. Therefore, the ganged selector switch 74a—75a—76a and 74b—75b—76b enables pump A to be turned on while pump B is kept off, or vice versa, when the selector switches 20a and 20b are positioned as shown in FIG. 3B. Either switch 20a or 20b may be operated to turn on the pump which would otherwise be off because of the setting of the ganged selector switch in circuit block 17.

When the ganged selector switch is in the position shown in FIG. 3B, in which its mobile contacts 74a and 74b are open-circuited, the operation of pumps A and B is under the control of a flip-flop 102. An input terminal 103 of flip-flop 102 is connected to the Q output terminal 58 of flip-flop 54. The Q output terminal 104 of flip-flop 102 is connected through a resistor 105a to the upper input terminal 73a of NAND gate 71a. The Q output terminal 106 of flip-flop 102 is connected through a resistor 105b to the upper input terminal of NAND gate 71b.

Flip-flop 102 reverses itself each time it receives a low input signal at terminal 103. After one such input signal, it will produce a high signal on its output terminal 104 and a low on its output terminal 106; after the next such input signal, it will produce a high signal on its output terminal 106 and a low on its output terminal 104. With this arrangement, the first pump A or B to turn on is alternated. For example, after one closing of the "start first pump" switch 12, pump A will be turned on, and after the next closing of switch 12, pump B will be turned on.

Whichever pump is turned on first in response to the closing of switch 12, the other pump will be turned on in response to the closing of the "start second pump" switch 13, which produces a low signal on line 70, causing the corresponding NAND gate 77a or 77b to produce a high (positive) output signal which turns on the second pump.

For example, assume that pump A is turned on first (in response to the closing of switch 12 and before switch 13 closes). That would happen if flip-flop 102 produces a high signal on its output terminal 104 and a low on its output terminal 106, causing NAND gate 71a to go low at its output and NAND gate 71b high at its output. With a high on line 70 before switch 13 closes, the output of NAND gate 77a would be high, turning on pump A, and the output of NAND gate 77b would be low, keeping pump B off. When switch 13 closes, putting a low on line 70, NAND gate 77a would continue to produce a high output signal, keeping pump A on. However, NAND gate 71b now would produce a high output signal, turning on pump B.

Conversely, if pump B had been turned on in response to the closing of switch 12 (which would happen if flip-flop 102 produced a high on its output terminal 106 and a low on its output terminal 104), the later closing of switch 13 would not affect pump B (which would remain on) but it would now turn on pump A.

SECOND PUMP DELAY AFTER POWER ON

All of the +12 volt terminals in the circuit are energized from a 120 volt, 60 Hz, power source through a power supply circuit of known design (not shown) having a transformer for stepping down the AC voltage and a rectifier for converting the stepped-down AC to +12 volts D.C. If there is any interruption of the AC power while both pumps A and B are on, the present control circuit delays the turning on of one of these pumps when AC power is restored. Only one pump will come on immediately; the other will come on only after a suitable time delay, such as 10 seconds.

The circuit block 19 is a timer of known design which controls the application of direct current from a +12 volt terminal 19' to line 70 via a rectifier 19''. In the event of a failure of the AC power, when power is restored the timer circuit 19 connects terminal 19' to line 70 as soon as power is restored, so as to establish a high signal on line 70 which lasts for the time interval of timer 19. At the end of this interval, timer 19 disconnects terminal 19' from line 70, so that the signal level on line 70 will now be determined by the override latch circuit 22, as already described. However, during the time interval, because of the high on line 70, the second pump cannot be turned on even if switch 13 is closed. Therefore, in the event of a power failure at a time when the liquid level is above line 13 in FIG. 1, causing both pumps to be on, when power is restored only the first pump comes on immediately, and the second pump remains off for a suitable time delay interval, such as ten or fifteen seconds.

ALARM AND LEAK INDICATOR CIRCUITS

Referring to FIG. 3A, the alarm circuit block 14' includes the alarm switch 14 and circuit elements which correspond to the already-described circuit elements in the stop circuit block 11'. Elements in block 14' which correspond to those in block 11' have the same reference numerals plus 300 and need not be described in detail.

In circuit block 14' the lower end of resistor 345 is connected to ground through a light-emitting diode 107, which gives a visual signal when transistor 337 is on. A Zener diode 108 is connected in parallel with diode 107.

The collector of transistor 337 is connected to one fixed contact 109 of a selector switch 110. This switch has a manually operable mobile contact 111 connected to a +12 volt power supply terminal. A second fixed contact 112 in this selector switch is connected to both input terminals of a NAND gate 113 acting as an inverter. A resistor 114 is connected between selector switch terminal 112 and ground. The output terminal of NAND gate 113 is connected to one input terminal of a NAND gate 115, whose output is connected to one input terminal 116 of a NAND gate 117. The second input terminal 118 of NAND gate 117 is connected to selector switch terminal 109 and the collector of transistor 337. The output terminal of NAND gate 117 is connected via a feedback line 119 to the second input terminal of NAND gate 115. The output terminal of NAND gate 117 also is connected to one input terminal 120 of a NAND gate 121, which has its second input terminal 122 connected to selector switch terminal 109 and the collector of transistor 337. The output terminal of NAND gate 121 is connected to both input terminals of a NAND gate 123 which acts as an inverter. An output line 124 from NAND gate 123 extends to the flasher circuit block 24 in FIG. 3B.

Selector switch 110 may be used to test the operation of circuit elements 114–123, inclusive, as follows:

(1) When switch contacts 111 and 112 are closed and with transistor 337 off, the output signal from NAND gate 113 will be low, the output from NAND gate 115 will be high, the output from NAND gate 117 will be high, the output from NAND gate 121 will be high, and the signal on line 124 will be low.

(2) When switch contacts 111 and 109 are closed, the output from NAND gate 113 will be high, the output from NAND gate 115 will be low, the output from NAND gate 117 will be high, the output from NAND gate 121 will be low, and the signal on line 124 will be low.

For normal operation, the mobile contact 111 of selector switch 110 is put in the open-circuited position shown in FIG. 3A. This puts the signal on line 124 under the control of the alarm switch 14.

As long as the liquid level in the tank is below line 14 in FIG. 1, transistor 337 in the alarm circuit block 14' will be off, the signal level at switch terminal 109 will be low, the output from NAND gate 113 will be high, the output from NAND gate 115 will be low, the output from NAND gate 117 will be high, the output from NAND gate 121 will be high, and the signal on line 124 will be low.

When the alarm switch 14 closes, switch terminal 109 goes high, the output from NAND gate 113 goes high, the output from NAND gate 115 goes low, the output from NAND gate 117 goes high, the output from NAND gate 121 goes low, and the signal on line 124 goes high.

The signal level on line 124 also is under the control of the seal leak circuit block 27 for pump A and the seal leak circuit block 28 for pump B. If either pump develops a leak through its seal, the signal level on line 124 will go high (just as it would if the alarm switch 14 where to close as a result of the liquid level rising to line 14 in FIG. 1). In addition, an individual lamp will turn on to indicate which pump has the leak.

The circuit components in block 27 correspond to those in the circuit block 11' for stop switch 11, with corresponding components having the same reference numerals as those in block 11' plus 400.

The circuit components in block 28 correspond to those in the stop switch circuit block 11', with corresponding components having the same reference numerals as those in block 11' plus 500.

The lower end of resistor 445 in seal leak circuit block 27 for pump A is connected to ground through a light-emitting diode 29. The collector of transistor 437 in block 27 is connected through a rectifier 125 to the collector of transistor 337 in the alarm circuit block 14' and to input terminals 118 and 122 of NAND gates 117 and 121, respectively.

The lower end of resistor 545 in seal leak circuit block 28 for pump B is connected to ground through a light-emitting diode 30. The collector of transistor 537 in block 28 is connected through a light-emitting diode 126 to the collector of transistor 337 in alarm circuit block 14' and to input terminals 118 and 122 of NAND gate 117 and 121, respectively.

The occurrence of a leak in either pump will cause the respective terminal A' (block 27) or B' (block 28) to be grounded, turning on the corresponding transistor 437 or 537. When transistor 437 is turned on, it turns on LEDs 29 and 31 and produces a high signal on line 124. When transistor 537 is turned on, it turns on LEDS 30 and 31 and produces a high signal on line 124.

It will be evident that the alarm LED 31 is turned on by the closing of alarm switch 14 or by a leak in either pump. However, the pump A leak LED 29 is turned on only by a leak in pump A and not by a closing of alarm switch 14 because rectifier 125 prevents this. Also, the pump B leak LED 30 is turned on only by a leak in pump B and not by a closing of alarm switch 14 because of the blocking action of rectifier 126.

If only LED 31 is on, this tells that the liquid level has gone above line 14.

If LED 31 and LED 29 are on at the same time, this indicates that pump A has a leak.

If LED 31 and LED 30 are on at the same time, this means that pump B has a leak.

Line 124 is connected to a timed intermittent circuit 24 of known design which controls the energization of a light transmitting diode 127 which operates a "Triac" circuit 128 of the same design as those for turning on the pumps. This "Triac" circuit is connected in series with alarm device 25 across 120 volt AC power supply terminals 129 and 130. When a high signal appears on line 124, it causes light transmitting diode 127 to be turned on for a brief time interval determined by timer circuit 24. The light from this diode causes the "Triac" circuit 128 to complete the energization path for the alarm device 25, turning it on. The alarm device 25 preferably is a horn or other audible signalling device or it may be a lamp. Timer 24 preferably turns the alarm device 25 on and off at a rapid rate, such as 60 times per minute.

The function of alarm device 25 is to signal that an emergency situation is occurring, after which the user looks to LEDs 31, 29 and 30 to determine the nature of the emergency, i.e., an excessively high liquid level in tank 10 or a leak in either pump.

While the present control circuit has been described with reference to float switches as the sensors, it is to be understood that the sensors might be devices other than float switches for sensing the liquid level. Also, the sensors might sense the liquid pressure in a closed tank or other container instead of the liquid level as the factor which determines the pumping operation. Also, in either a liquid level-operated control or a liquid pressure-operated control, the pumps may pump water out of the container, as shown and described, or they may pump water into the container in response to the level or pressure condition read by the sensors.

I claim:

1. In a liquid pumping system for use with a liquid reservoir, said system having:

a motor-driven pump operatively arranged to pump liquid relative to the reservoir;

a first binary sensor operatively arranged to be actuated when the liquid reaches a predetermined first condition in the reservoir;

and a second binary sensor operatively arranged to be actuated when the liquid reaches a predetermined second condition in the reservoir;

the improvement which comprises:

a set-reset flip-flop having set and reset input terminals first and second output terminals;

circuit means operatively connecting said output terminals of the flip-flip to said pump to turn the pump on and off;

and circuit means operative (a) in response to a first binary condition of said first sensor and a first binary condition of said second sensor to cause flip-flop to keep the pump off, and (b) in response to a second binary condition of said first sensor and a second binary condition of said second sensor to reverse said flip-flop for turning on the pump.

2. A liquid pumping system according to claim 1, wherein said last-mentioned circuit means includes:

a first circuit operatively connecting said first sensor to said reset input terminal of the flip-flop;

and a second circuit operatively connecting said second sensor to said set input terminal of the flip-flop.

3. A liquid pumping system according to claim 2, wherein said first circuit includes:

a first transistor operatively connected to said first sensor to turn on in response to the occurrence of said first condition of the liquid in the reservoir;

and a NAND gate having first and second input terminals and an output terminal, said first input terminal being connected to the output of said transistor, circuit means connecting said second input terminal to a D.C. power supply terminal, and said output terminal of the NAND gate being connected to said reset terminal of the flip-flop.

4. A liquid pumping system according to claim 3, wherein said second circuit includes:

a second transistor operatively connected to said second sensor to turn on in response to the occurrence of said second condition of the liquid in the reservoir, said second transistor having its output connected to said set terminal of the flip-flop to cause said flip-flop to turn on said pump in response to the occurrence of said second condition of the liquid in the reservoir.

5. A liquid pumping system according to claim 2, and having a second pump, and a third binary sensor operatively arranged to be actuated when the liquid reaches a predetermined third condition in the reservoir, said system further comprising:

an override latch circuit having a pair of input terminals an output terminal operatively connected to turn the second pump on and off, said override latch circuit having one of its input terminals connected to said reset input terminal of the flip-flop;

a third circuit operatively connecting said third sensor to said second input terminal of said override latch circuit;

said override latch circuit having a plurality of binary logic elements operatively connected between its input terminals and its output terminal to (a) produce an output signal of one binary state on its output terminal for keeping the second pump off while said third sensor is in a first binary state because said predetermined third condition of the liquid in the reservoir is not occurring, (b) to produce an output signal of the opposite binary state on its output terminal in response to a second binary condition of said third sensor caused by the occurrence of said third condition of the liquid in the reservoir, and (c) to maintain said output signal in said opposite binary state and keep said second pump on after said third sensor returns to said first binary condition as long as said first sensor remains in its second binary condition, and (d) to change said output signal on its output terminal to said one binary state when said first sensor returns to its first binary condition for turning off both pumps.

6. A liquid pumping system according to claim 5, wherein said override latch circuit comprises:

a first inverter having its input connected to said first input terminal of the override latch circuit;

a second inverter having its input connected to second input terminal of the override latch circuit;

a first NAND gate having first and second input terminals and an output terminal, said first input terminal of said NAND gate being connected to the output terminal of said first inverter;

a second NAND gate having a first input terminal connected to the output of said second inverter, a second input terminal connected to the output of said first NAND gate, and an output terminal connected to the second input terminal of said first NAND gate;

a third NAND gate having a first input terminal connected to the output terminal of said first NAND gate, a second input terminal connected to the output of said second inverter, and an output terminal;

and a third inverter having its input connected to the output of said third NAND gate and its output operatively connected to the output terminal of the override latch circuit.

7. In a liquid pumping system for use with a liquid reservoir, said system having:

two motor-driven pumps operatively arranged to pump liquid relative to said reservoir;

a first binary sensor operative to a first binary state when the liquid reaches a predetermined first condition in the reservoir and operative to the opposite binary state when the liquid in the reservoir no longer reaches said first condition;

a second binary sensor operative to a first binary state when the liquid reaches a predetermined second condition in the reservoir and operative to the opposite binary state when the liquid in the reservoir no longer reaches said second condition;

and a third binary sensor operative to a first binary state when the liquid reaches a predetermined third condition in the reservoir and operative to the opposite binary state when the liquid in the reservoir no longer reaches said third condition;

the improvement which comprises:

a start latch circuit operatively connected between said first and second sensors and said pumps to turn on one of said pumps in response to operation of said first sensor to its first binary state followed by operation of said second sensor to its first binary state;

and an override latch circuit operatively connected between said first and third sensors and said pumps to turn on the other of said pumps in response to operation of said third sensor to its first binary state following operation of said first sensor to its first binary state;

said first sensor being operatively connected to said override latch cir;cuit to turn off said other pump in response to operation of said first sensor to its opposite binary state following operation of said third sensor to its opposite binary state;

and said first sensor being operatively connected to said start latch circuit to turn off said one pump in response to operation of said first sensor to its opposite binary state following operation of said second sensor to its opposite binary state.

8. A pumping system according to claim 7, and further comprising:

a pump selector circuit operatively connected between said start and override latch circuits and said pumps to reverse the sequence in which the pumps turn on in the next cycle of operation occurring after said first sensor has been operated again to its first binary state.

9. A pumping system according to claim 8, wherein:

said pump selector circuit comprises a flip-flop having (a) an input terminal connected to an output terminal of said start latch circuit, and (b) a pair of output terminals operatively connected separately to said pumps to control the turning on of said pumps.

10. A pumping system according to claim 9, wherein:

said start latch circuit includes a set-reset flip-flop having set and reset input terminals and first and second output terminals, said first output terminal of the latch circuit flip-flop being connected to said input terminal of the pump selector circuit flip-flop;

said pump selector circuit includes a first pair of NAND gates each having first and second input terminals, the first input terminal of one of said NAND gates being connected to one of said output terminals of the flip-flop in the pump selector circuit, the first input of the other NAND gate being connected to the other output terminal of the flip-flop in the pump selector circuit, and said second input terminal of both NAND gates being connected to said second output terminal of the flip-flop in the start latch circuit;

and said pump selector circuit includes a second pair of NAND gates having respective first input terminals each connected to the output of a corresponding NAND gate of said first pair and having respective second input terminals connected to the output of said override latch circuit, one of said NAND gates of the second pair having its output operatively connected to one of said pumps, and the other of said NAND gates of the second pair having its output operatively connected to the other of said pumps.

11. A liquid pumping system according to claim 10, wherein said override latch circuit comprises:

a first inverter having its input connected to said reset input terminal of the flip-flop in the start latch circuit;

a second inverter having its input operatively connected to said third sensor;

a first NAND gate having first and second input terminals and an output terminal, said first input terminal of said NAND gate being connected to the output terminal of said first inverter;

a second NAND gate having a first input terminal connected to the output of said second inverter, a second input terminal connected to the output of said first NAND gate in the override latch circuit, and an output terminal connected to the second input terminal of said first NAND gate in the override latch circuit;

a third NAND gate having a first input terminal connected to the output terminal of said first NAND gate in the override latch circuit, a second input terminal connected to the output of said second inverter, and an output terminal;

and a third inverter having its input connected to the output of said third NAND gate and its output operatively connected to the said second input terminals of said second NAND gates in the pump selector circuit.

12. A liquid pumping system according to claim 11, and further comprising:

a fourth binary sensor operative to a first binary state when the liquid reaches a predetermined fourth condition in the reservoir;

and alarm signalling means operatively connected to said fourth sensor to signal an alarm in response to operation of said fourth sensor to its first binary state.

13. A liquid pumping system according to claim 12, wherein said alarm signalling means includes:

a light source operatively connected to said fourth sensor to be turned on by operation of said fourth sensor to its first binary state;

an audible alarm device;

and means for turning said audible alarm device on and off intermittently after operation of said fourth sensor to its first binary state.

14. A liquid pumping system according to claim 13, and further comprising:

leak sensors operatively associated with said pumps individually to respectively detect a leak in either pump;

light sources operatively connected respectively to said leak sensors to be turned on in response to a leak in the respective pump;

and circuit means operatively connecting said leak sensors to said means for turning said audible alarm device on and off, whereby to operate said audible alarm device in response to a leak in either pump.

15. A liquid pumping system according to claim 10, wherein said motor-driven pumps are operated by an electrical power supply, and further comprising:

a timer operatively connected to said second input terminals of said second pair of NAND gates in the pump selector circuit to apply a signal thereto for a predetermined time interval permitting only one of said pumps to be turned on by the restoration of power following a failure of the power supply for the pumps.

16. A liquid pumping system according to claim 7, and further comprising:

a fourth binary sensor operative to a first binary state when the liquid reaches a predetermined fourth condition in the reservoir;

and alarm signalling means operatively connected to said fourth sensor to signal an alarm in response to operation of said fourth sensor to its first binary state.

17. A liquid pumping system according to claim 16, wherein said alarm signalling means includes:

a light source operatively connected to said fourth sensor to be turned on by operation of said fourth snesor to its first binary state;

an audible alarm device;

and means for turning said audible alarm device on and off intermittently after operation of said fourth sensor to its first binary state.

18. A liquid pumping system according to claim 17, and further comprising:

leak sensors operatively associated with said pumps individually to respectively detect a leak in either pump;

light sources operatively connected respectively to said leak sensors to be turned on in response to a leak in the respective pump;

and circuit means operatively connecting said leak sensors to said means for turning said audible alarm device on and off, whereby to operate said audible alarm device in response to a leak in either pump.

19. A liquid pumping system according to claim 7 wherein said motor-driven pumps are operated by an electrical power supply, and further comprising:

means, operable upon a failure of the power supply for the pumps followed by a restoration of power, for preventing both pumps from being turned on substantially simultaneously upon the restoration of power.

* * * * *